US010246846B2

(12) United States Patent
Desmeules

(10) Patent No.: US 10,246,846 B2
(45) Date of Patent: Apr. 2, 2019

(54) INTERCONNECTABLE HOLLOW STEEL PIPE FOR CONSTRUCTING FORCE DRIVEN PILES AND THE METHOD OF FORMING THE PILE

(71) Applicant: Brooke DeSantis, Montreal (CA)

(72) Inventor: Alain Desmeules, Montreal (CA)

(73) Assignee: Brooke DeSantis, Montreal, QC ( * ) Notice: Subject to any disclaimer, the term of this patent is extended or adjusted under 35 U.S.C. 154(b) by 74 days.

(21) Appl. No.: 15/731,023

(22) Filed: Apr. 10, 2017

(65) Prior Publication Data

US 2018/0291583 A1 Oct. 11, 2018

(51) Int. Cl.

| | |
|---|---|
| ***E02D 5/52*** | (2006.01) |
| ***E02D 5/28*** | (2006.01) |
| ***E02D 7/28*** | (2006.01) |
| ***E02D 37/00*** | (2006.01) |

(52) U.S. Cl.

CPC ..... *E02D 7/28* (2013.01); *E02D 5/28* (2013.01); *E02D 5/526* (2013.01); *E02D 37/00* (2013.01)

(58) Field of Classification Search

CPC .. E02D 5/00; E02D 5/28; E02D 5/285; E02D 5/523; E02D 5/526; E02D 7/28; E02D 27/12; E02D 37/00

USPC ..... 405/231, 232, 249, 251; 403/292; 285/31

See application file for complete search history.

(56) References Cited

U.S. PATENT DOCUMENTS

| | | | | |
|---|---|---|---|---|
| 1,051,427 A * | 1/1913 | McLuskey | F16L 37/0925 | 242/118.41 |
| 4,852,501 A * | 8/1989 | Olson | A47B 57/265 | 108/107 |
| 5,078,534 A * | 1/1992 | White | F16B 7/042 | 403/292 |
| 6,183,167 B1 * | 2/2001 | Ruiz | E02D 5/285 | 403/379.3 |
| 2004/0104319 A1 * | 6/2004 | Dean | F16B 7/025 | 248/146 |
| 2006/0067794 A1 * | 3/2006 | Mitchell | E02D 27/48 | 405/230 |
| 2007/0296208 A1 * | 12/2007 | Leblanc | F16L 1/10 | 285/31 |
| 2008/0157521 A1 * | 7/2008 | Davis | E21B 17/046 | 285/331 |

* cited by examiner

*Primary Examiner* — Benjamin F Fiorello

*Assistant Examiner* — Stacy N Lawson

(74) *Attorney, Agent, or Firm* — Guy Houle; Houle Patent Agency Inc.

(57) ABSTRACT

An interconnectable hollow metal pipe for the construction of force driven piles is described. A pipe connector is permanently secured to one of opposed open transverse ends of the hollow metal pipe for interconnecting like pipes together. The pipe connector has an inner fitment section for engagement in the one of opposed open end and a protruding pipe connecting section for tight sliding fit connection in the other hollow open end of another interconnectable hollow metal pipe. The pipe connector has securement formations which in combination with the pipe open end, to which it is connected to, forms at least two spaced-apart weld cavities with an outer surface of the pipe to receive therein a recessed weld which does not exceed the pipe outer surface to provide an unobstructed pile outer surface by two or more of the interconnectable hollow metal pipes interconnected end-to-end by the connectors.

12 Claims, 11 Drawing Sheets

INTERCONNECTABLE HOLLOW STEEL PIPE FOR CONSTRUCTING FORCE DRIVEN PILES AND THE METHOD OF FORMING THE PILE

TECHNICAL FIELD

The present invention relates to an interconnectable hollow steel pipe for the construction of force driven piles and wherein the interconnectable pipe has a connector immovably secured at one of opposed free ends of the pipe for interconnection with like pipes and wherein a pile so formed has an unobstructed outer surface throughout its length. The invention also relates to the method of forming piles with two or more of the interconnectable pipes.

BACKGROUND ART

Reference is made to my earlier U.S. Pat. No. 8,506,206 which describes a composite pile formed of interconnected rigid hollow tubes and which is incorporated herein by reference. In an earlier of my patents, namely U.S. Pat. No. 7,708,317 there is described a pipe connector to interconnect opposed hollow ends of two hollow pipe sections. These connectors are secured to the pipes when a pile is being formed on the construction site and during various types of weather conditions and usually by at least some skilled labor, such as welders. All sorts of connectors are also known which are securable to opposed ends of pile sections to splice them together and many of them are in the form of collars. Because these connectors usually consist of different parts, such parts can become damages on the work site or become lost causing all sorts of problems including time lost and increased costs. Further, piles constructed with obstructions projecting from the outer surface of the pile cylinders cause underground problems due to bad installations or obstructions with rocks resulting in underground kinking of the pile or underground breakages. Most pile structures are also not adaptable to foundation brackets used to connect and drive piles into the ground by an hydraulic ram connectable to the bracket as any protrusion in the outer surface of the pipes or connectors is an obstruction to its close passage through guide rings or tubes secured to the bracket to guide the pile tubes along a straight axis as the pile is being formed and driven into the ground.

By welding the joints of pile sections on site various problems occur due to several factors, such as the skill of the welder person, the existing climate condition, faulty weld joints, faulty weld equipment, and expensive labour seeing the welder person needs to be present on site during the entire construction and installation of the piles, noting that is skill is only required when a joint has to be welded or the top pipe of the pile as to be cut and welded to the foundation bracket. Because the welding of these pipe joints is very time consuming, up to 45 minutes for each joint, the entire crew and machinery becomes idle during the welding process. This lost of time adds to the cost of the installation and sometimes when facing deadlines, penalties are imposed on the installation company if the delivery is late. Still further, because both ends of some connectors require engagement in a respective one of opposed ends to two pipe sections, adapters are required to be installed not to damage the connector when driven into the open end of a lower one of the two pipe prior to positioning the open end of the upper pipe in the connector. This can result in defective connections causing the pile to kink which can result in breakage at the joint. Thus, the assembly and installation of connectors and the use of a welder person at the construction site is problematic, slow and expensive and does not assure repeated quality of the interconnections of the pipe sections of the pile.

SUMMARY OF THE INVENTION

It is a feature of the present invention to provide an interconnectable hollow steel pipe for the construction of force driven piles and which substantially overcomes the above mentioned disadvantages of the prior art.

It is another feature of the present invention to provide an interconnectable hollow steel pipe and wherein the pipe connector is preformed and permanently and perfectly secured to an end of the pipe and wherein there are no obstructions, formed by weld material of the connection, to the outer surface of the pipes and a pile formed by force connecting these pipes end-to-end at a construction site.

A further feature of the present invention is to provide an interconnectable hollow steel pipe and wherein the assembly thereof to form piles is simplified and results in less time for the formation of piles and does not require a permanent welder person on site during the assembly of the piles.

Another feature of the present invention is to provide a hollow pipe connector which does not require assembly on site and wherein the connection thereof is not affected by bad climatic conditions or weld defects made on site.

A still further feature of the invention is to provide a hollow pipe interconnection which also permits rotational displacement of the pile by the application of a torque force as it is forced downwardly into the ground.

A still further feature of the present invention is to provide a simplified method of forming a hollow steel pile as it is force driven into the ground for stabilizing a foundation wall of a building structure.

According to the above features, from a broad aspect, the present invention provides an interconnectable hollow metal pipe for the construction of force driven piles. The hollow metal pipe is an elongated hollow pipe of predetermined length having a pipe connector with a fitment section for connection in one of opposed hollow transverse ends of the hollow metal pipe. The other opposed hollow transverse end is a hollow transverse end. The pipe connector has a protruding pipe connecting section dimensioned for tight sliding fit in the other hollow transverse end of another of the hollow metal pipe. The pipe connector has securement means forming at least two spaced-apart weld cavities with an outer surface of the hollow metal pipe to have formed therein a weld not exceeding the outer surface of the pipe to provide an unobstructed pile outer surface comprised of two or more of the hollow metal pipes interconnected end-to-end by the pipe connectors.

According to another broad aspect of the invention the securement means is comprised by a flat transverse metal connector disc secured to the pipe connector intermediate the inner fitment section and the protruding pipe connection section. The connector disc has an outer circumferential edge shaped for flush fit with the outer surface of the hollow metal pipe. The at least two spaced-apart weld cavities are formed in the outer circumferential edge and wherein the weld interconnects the disc cavity and the disc with a transverse end wall of the hollow metal pipe below the outer surface of the hollow metal pipe.

According to a still further broad aspect of the invention the securement means is comprised by the one of the opposed hollow transverse ends having two or more spaced-apart connector connecting slots of predetermined length extending longitudinally and parallel to a central longitudinal axis of the hollow metal pipe. The protruding pipe connecting section has two or more securing formations dimensioned and disposed for close fit in a respective one of the two or more connector connecting slots. An arresting formation is formed with each of the securing formations and each of the securing formations is dimensioned to form the weld cavity in the slots with respect to the outer surface of said hollow metal pipe.

According to a further broad aspect of the present invention there is provided a method of forming a hollow metal pile which is force driven into the ground for stabilizing a foundation wall of a building structure. The method comprises the steps of:

(i) providing two or more interconnectable hollow metal pipes as defined herein above;
(ii) securing a ground penetrating head to the protruding pipe connecting section of the pipe connector of a first of two or more interconnectable hollow metal pipes;
(iii) positioning the first of the two or more interconnectable hollow metal pipes at a precise location with respect to an existing foundation wall or foundation wall to be constructed;
(iv) applying a downward drive force to the first of the metal pipes to drive it into the ground;
(v) positioning the protruding pipe connection of a further of the two or more of the hollow metal pipes into the free open end of the first of the metal pipes, and
(vi) applying a further downward drive force to the further of the hollow metal pipes to frictionally and forceably engage the protruding pipe connection of the further of the two or more of the hollow metal pipes in the free open end of the first hollow metal pipe and continue to drive the first and further of the hollow steel pipes into the ground.

BRIEF DESCRIPTION OF THE DRAWINGS

A preferred embodiment of the present invention will now be described with reference to the accompanying drawings in which.

DESCRIPTION OF PREFERRED EMBODIMENTS

Figure 1:
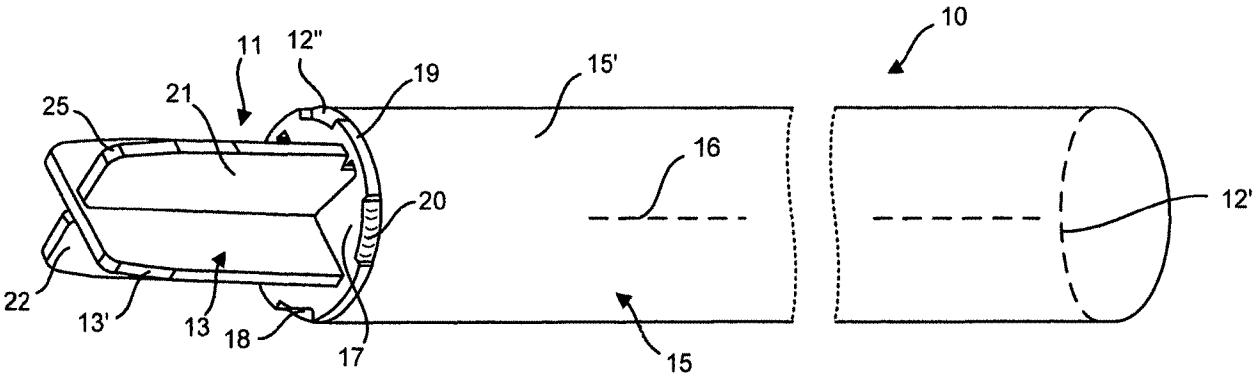
FIG. 1 is a fragmented perspective view of the interconnectable hollow steel pipe of the present invention to form force driven piles and illustrating an example of the securement means to secure the pipe connector to an hollow end of the pipe.

Referring now to the drawings and more particularly to FIG. 1, there is shown generally at 10 the interconnectable hollow metal pipe of the present invention for the construction of force driven piles, as will be described later. The interconnectable pipe is an elongated hollow steel pipe 15 of predetermined length and having opposed hollow ends 12 and 12'. A pipe connector 11 is permanently secured by welding to one of its hollow ends, herein hollow end 12. The other hollow end 12' is a free hollow end to receive the connector 11 of another interconnectable pipe 10 as will be described later. The pipe connector 11 is welded at a pipe construction plant prior to being shipped to an installation site. A jig may be provided to insure perfect assembly and the perfection of connecting welds being formed.

Figure 2B:
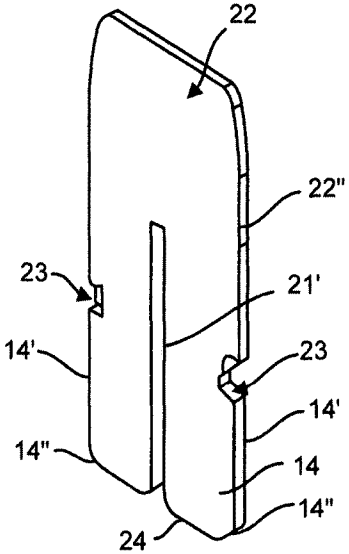
FIGS. 2A and 2B are plan views of the connector plates which are interconnected together is sliding fit with one another as illustrated in FIG. 2C.
Figure 2A:
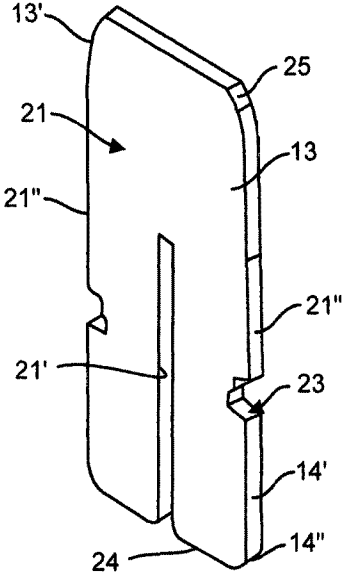
Figure 2D:
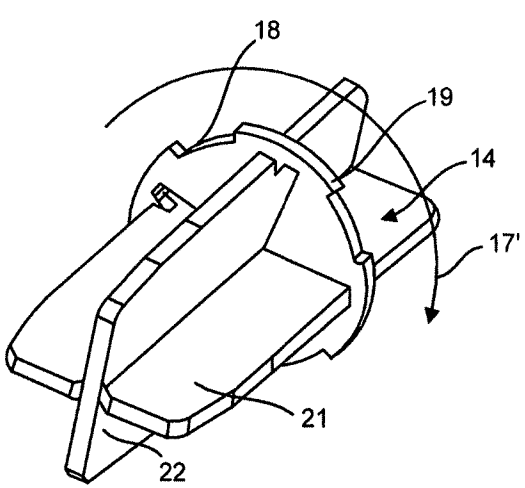
FIGS. 2D to 2F are perspective views of the assembled pipe connector illustrating how the assembly is made and fitted in a hollow end of a pipe.
Figure 2F:
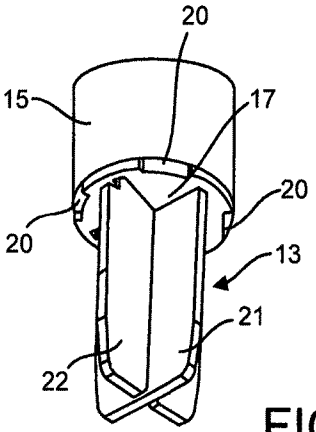
Figure 2C:
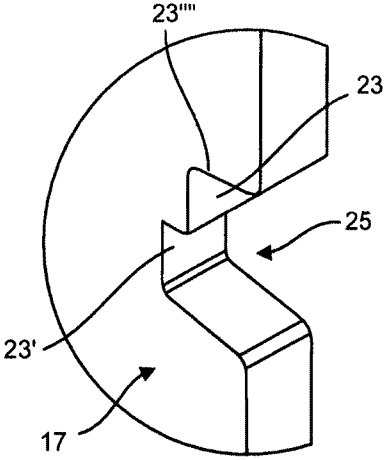
FIG. 2C is an enlarged view of the shape of the disc connecting notch.
Figure 2E:
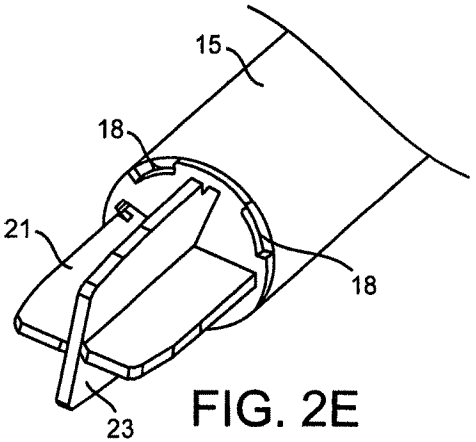
Figure 3A:
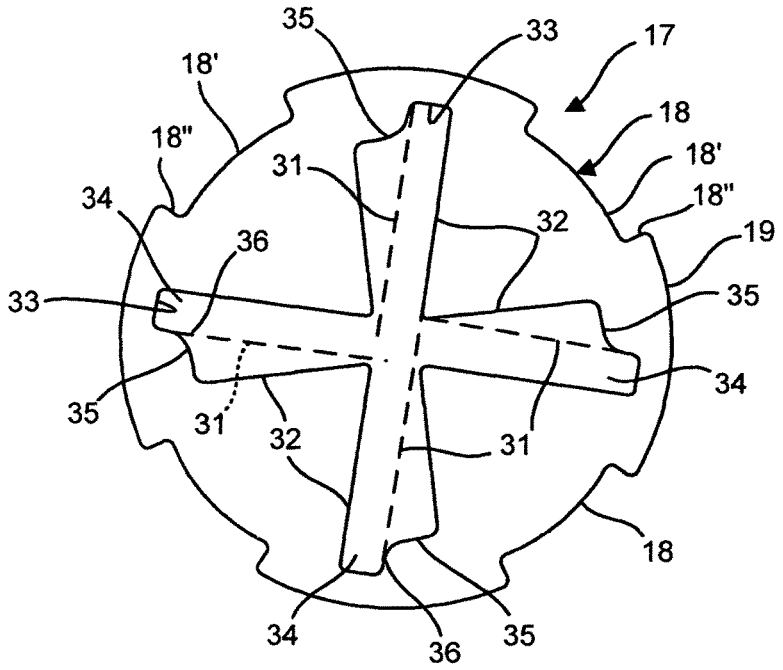
FIG. 3A is a plan view of the connector disc.
Figure 3B:
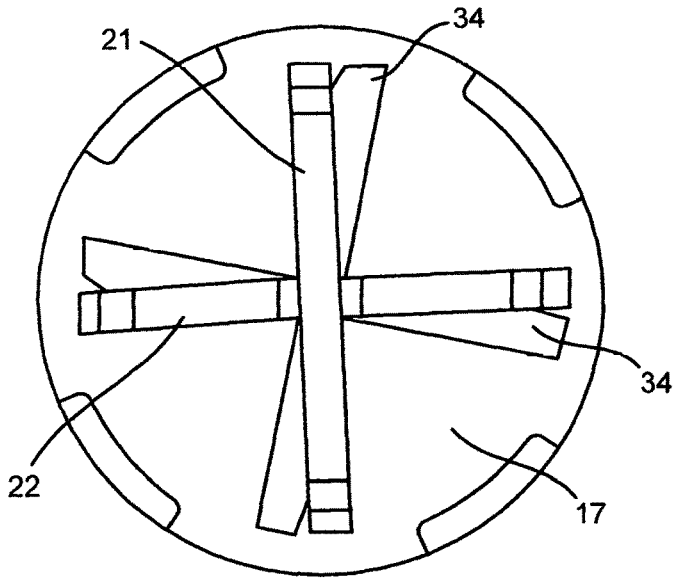
FIG. 3B is a further plan view of the connector disc showing the connector plates secured therein with the disc extending transversely to the connector plates.
Figure 4A:
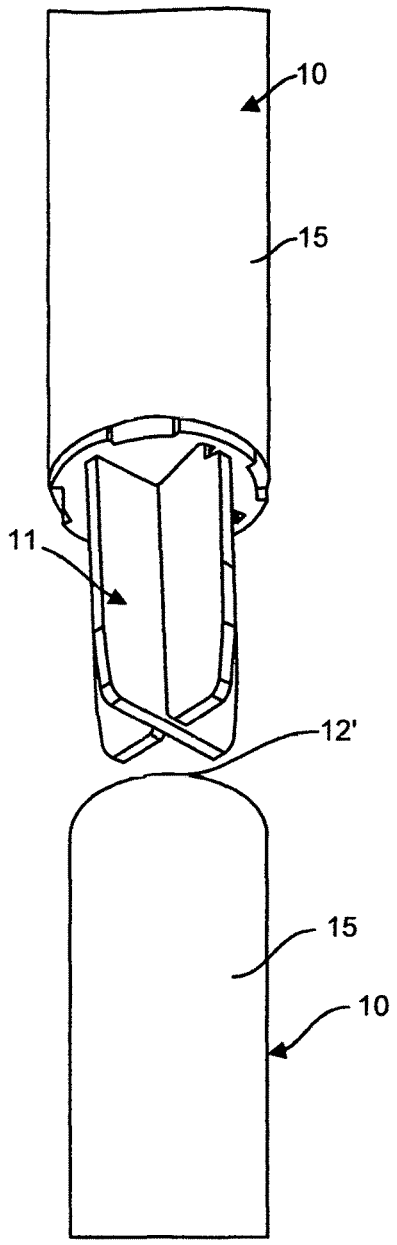
FIG. 4A is a perspective view showing the manner of interconnecting two hollow metal pipes end-to-end.
Figure 4B:
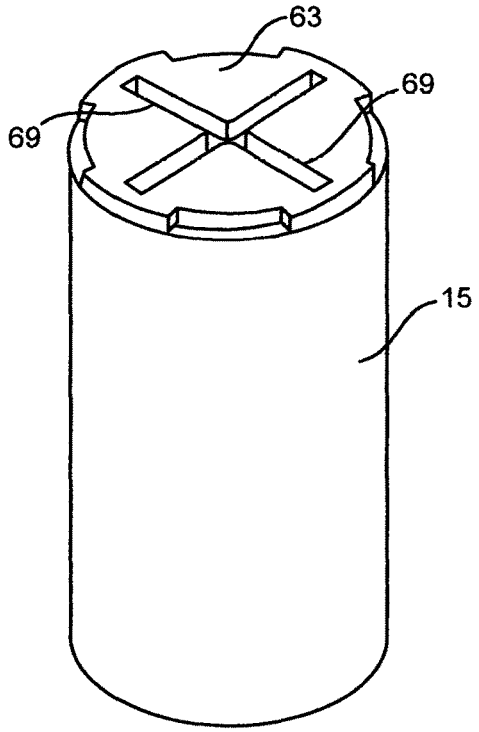
FIG. 4B is a perspective view showing a torque transmitting and pipe interconnecting disc secured to the hollow end of the pipe opposite the pipe connector end for transmitting torque to the pile being formed.

With further reference to FIGS. 2 to 4, the pipe connector 11 is formed with a protruding pipe interconnecting section 13 which is dimensioned for tight sliding fit in the hollow end 12' of another like pipe 10. It also has a pipe inner fitment section 14 for close fit retention of the pipe connector 11 in the hollow end 12 whereby to position the pipe connector 11 in alignment with the central longitudinal axis 16 of the steel pipe 15. A flat transverse steel connector disc 17, constituting a securement means is secured transversely of the pipe connecting section 13 and has two or more, herein four, spaced-apart weld cavities 18 formed in an outer circumferential edge 19 thereof, as better seen from FIG. 3A. The disc is dimensioned wherein the outer circumferential edge 19 of the disc 17 lies flush with the pipe outer surface 15' when the pipe inner fitment section 14 is positioned in the hollow end 12 of the pipe 15. As shown in FIG. 1 welds 20 are formed in the weld cavities 18 to interconnect the disc 17 and the pipe connector 11 to the pipe 15.

With reference to FIGS. 2A to 2E. it can be seen that the pipe connector 11 is formed by two identical metal plates 21 and 22 interconnected to one another in transverse alignment by means of a central interconnecting slot 21' and 22' formed in a respective one of the steel plates 21 and 22 from the end edge 24 of the inner fitment section 14 to form the assembly shown in FIG. 2D. The steel plates 21 and 22 are of substantially rectangular outline and each has a disc attachment notch 23, respectively, formed in opposed longitudinal edges 21" and 22", respectively, and disposed in transverse alignment with one another. The pipe inner fitment section 14 of the plates 21 and 22 have opposed parallel side edges 14' for close friction fit in the hollow end 12 of the pipe 15. Angular notches 14" are formed at the base of these side edges 14 with the end edge 24 for ease of insertion of the inner fitment section 14 in the hollow pipe end 12. The longitudinal edges 21" and 22" of the interconnecting section 13 of the plates 21 and 22 have a slight inward taper of about 2 degrees and their outer end section 13' which merges into a more abrupt slope of about 7 degrees and termination in a still more inwardly inclined end notch 25 to facilitate positioning the pipe connecting section 13 in the hollow end 12' of another interconnectable pipe 10.

As shown in FIGS. 3A to 4B, the connector disc 17 has an x-shaped attaching through bore 30 formed centrally therein. This attaching through bore 30 is dimensioned to permit insertion of the connector plates 21 and 22 when attached to one another as shown in FIG. 2D. Phantom lines 31 shows the interconnected plates disposed in the transverse arms 32 of the attaching through bore 30. The far end or top end 33 of each of the transverse arms 32 are shaped to define a plate insertion passage 34 and a plate connecting formation constituting a curved cam surface 35. The plate insertion passage 34 permits passage of the inner fitment section 14 of the connector plates 21 and 22 with the curved cam surface leading edge 36 aligned with the notch 23 of the plates 21 and 22. As shown in FIG. 2C, the notch 23 has a deep section 23' and a cam engaging raised section 23". The disc 17 is inserted and slid over the inner fitment section 14 of the assembled plates 21 and 22 until it loosely falls into the deep section 23' of the notch 23. The disc is then pushed to align over the cam engaging section 23", which is a clamping surface, and firmly against the side wall 23" of the notch 23. The disc is ten forced rotated in the direction of arrow 17', along an arc of 15 degrees, wherein the clamping surface of the cam engaging section 23" is forced to lock in friction fit with the disc 17 extending perfectly transverse to the interconnected plates 21 and 22 and the longitudinal axis 16 of the pipe 15. FIG. 3B shows the position of the plates 21 and 22 in their engaged position with the disc 1.

As shown in FIG. A, the notches forming weld receiving cavities 18, are elongated notches and disposed in an area of the circumferential edge 19 intermediate the transverse arms 32 of the x-shaped through bore opening 30 in stronger areas of the connector disc 30 where there is more material for added strength with the welds connections with the end wall 12" of the hollow ends 12 and 12'. The weld receiving cavities 18 have a depth which is substantially equal to the thickness or end wall 12" of the steel pipe 15 whereby the weld 20 forms a connection between the bottom wall 18' and opposed side walls 18" of the notches 18 with the end wall 12" of the pipe hollow end 12. The weld cavities 18 permit sufficient weld material for form a solid interconnection of the pipe connector 11 with the pipe hollow end 12 with the weld 20 recessed from the outer surface 15' of the pipe whereby no obstructions protrude over the outer surface 15' to permit the formation of piles having a continuous smooth outer surface formed by a plurality of interconnected steel pipe 10. It is pointed out that the entire assembly of the pipe connector 11 and its securement to the hollow pipe 15 is made in an indoor shop facility to assure high quality workmanship and to obtain all of the advantages mentioned herein of not having to make assemblies and welding on a work site.

With reference now to FIGS. 5 to 11 there is shown another example of the preferred embodiment of the interconnectable hollow steel pipe, herein steel pipe 10'. As herein shown, the elongated hollow steel pipe 15 has a differently formed pipe connector securement means, for securement in the pipe end 12. The securement means is herein constituted by two or more spaced-apart connector connecting slots 41, herein four slots of predetermined length formed and extending longitudinally and parallel to the central longitudinal axis 16 of the hollow pipe 15. The protruding pipe connecting section 42 is formed by two interconnected steel plates 43 and 44 having securing ridge formations 43' and 44' formed therewith and disposed for close sliding fit in a respective one of the four connecting slots 41 to form weld cavities 46 with the outer surface 15' of the pipe 15 for securing the pipe connector 40 to the open end 12 of the pipe 15 with the welds 45 being recessed from the outer surface 15' of the pipe 15, as better seen from FIG. 11.

Figure 5:
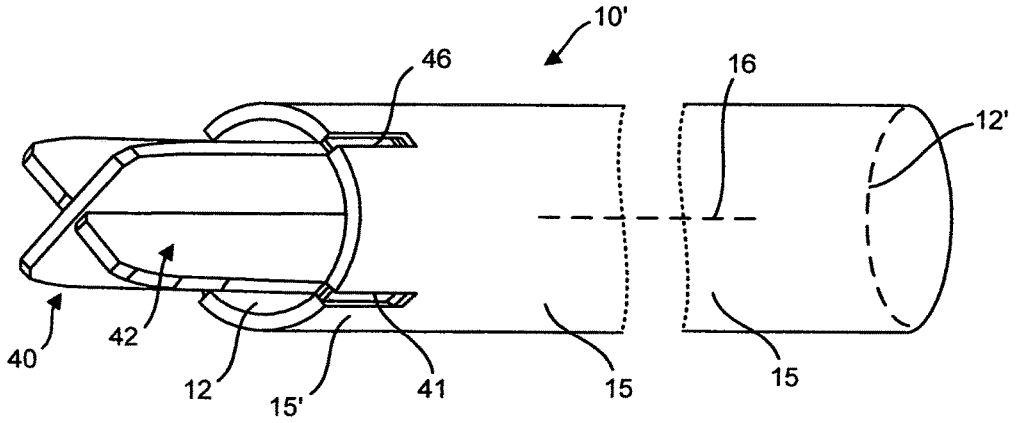
FIG. 5 is a fragmented perspective view similar to FIG. 1 illustrating and another example of the securement means and wherein the connector is differently formed and secured in an hollow end of the pipe.
Figure 6:
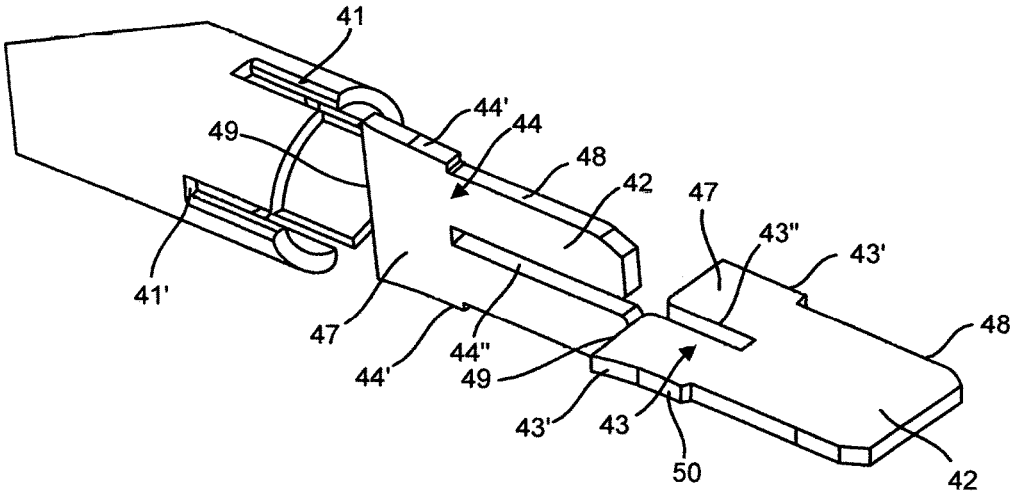
FIG. 6 is a fragmented explosive view showing the plates interconnection to one another and to the hollow end of the pipe.
Figure 9:
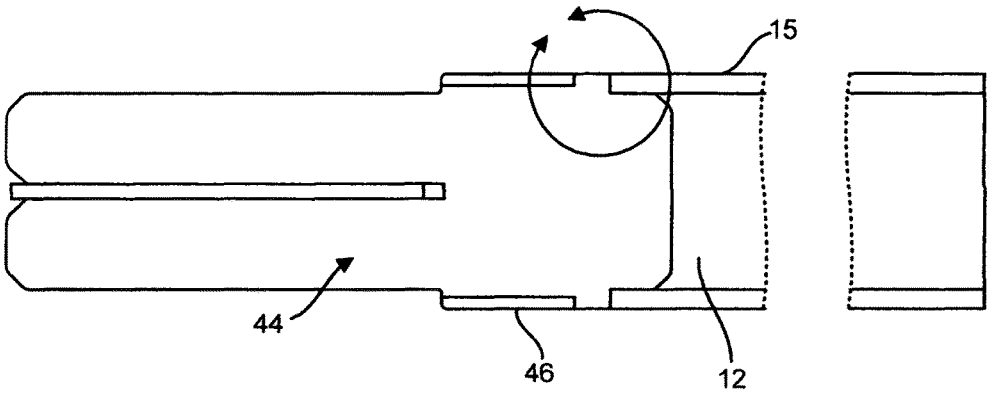
FIG. 9 is a fragmented side view showing the connector of FIG. 8 in position in the hollow end of the pipe with the securement formation lying in the connecting slot and forming a weld cavity.
Figure 10:
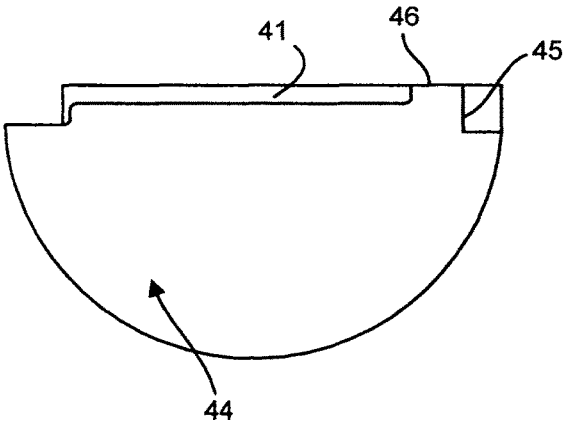
FIG. 10 is an exploded view showing the weld cavity illustrated in FIG. 9.
Figure 11:
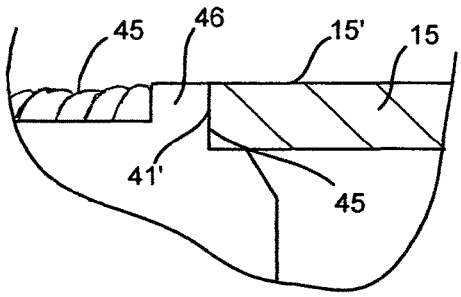
FIG. 11 is another exploded fragmented view showing a weld formed in the weld cavity and its relationship to the outer surface of the pipe.

As with the embodiment of FIG. 1, the pipe connector 40 is formed of two steel plates 43 and 44, see FIG. 6, which are interconnected in sliding fit with one another by a transverse central slot 43" and 44" formed in the plates, respectively, whereby the plates are retained at right angle with one another. The securing ridge formations 43' and 44' form a pipe inner fitment section 47 which is dimensioned for close fit retention in the open end 12 of the pipe 15 with the ridge formations 44' and 43' being disposed in a bottom section of the slots 41. As shown in FIGS. 9 to 11, the ridge formations 43' and 44' formed on each side edge of the plates 43 and 44 have a straight ridge upper surface 44" whereby to extend parallel to the outer surface 15' of the hollow pipe 15 to form a weld cavity 45' of constant depth along the slots 41. An arresting formation in the form of an abutment stump 46 is formed integral at an inner end of the ridge section 44' and has a rear vertical abutment edge 45 for abutment with the end wall 41' of the connector connecting slot 41. The pipe connecting section 42 is also formed with a tapered end projection section 48 disposed forwardly of the abutment stump for ease of insertion of the pipe connecting section 42 of the pipe connector 40 in the hollow transverse end section 12 of the pipe 15 as shown in FIG. 5.

Figure 7:
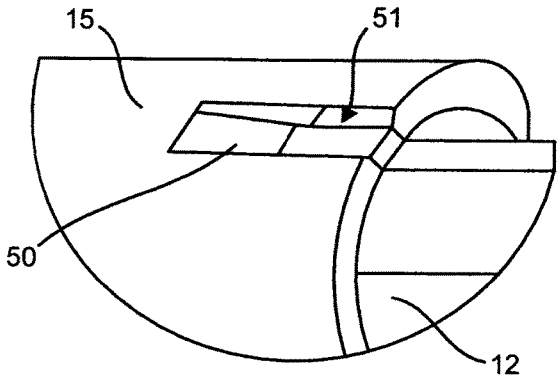
FIG. 7 is a fragmented view showing the weld cavity formed in the connector connecting slots formed in the free end connecting section of the pipe.
Figure 8A:
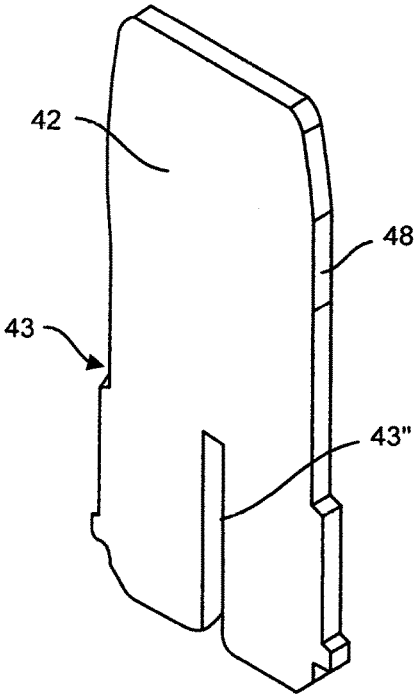
FIGS. 8A and 8B are plan views of the connector plates illustrating the shape of the securing formations formed in the attachment section of the plates to form the weld cavities.
Figure 8B:
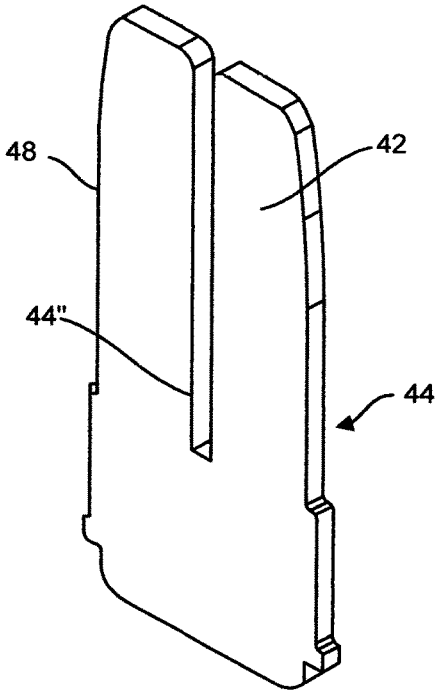

FIGS. 6 and 7 illustrates another shape of the securing ridge formations 43' and 44' wherein the ridge 44' is formed from a straight rear edge 49 of the plates 43 and 44 and slopes inwardly to a recessed section 50 to form a weld cavity 51 as illustrated in FIG. 7. The top sections of the rear edge 49 forms an abutment wall 41' of the slots 41. The protruding pipe connecting section 42 formed by the interconnected plates 43 and 44 is of like constructions to the interconnected plates 21 and 22 of the embodiment of FIG. 1.

Figure 12A:
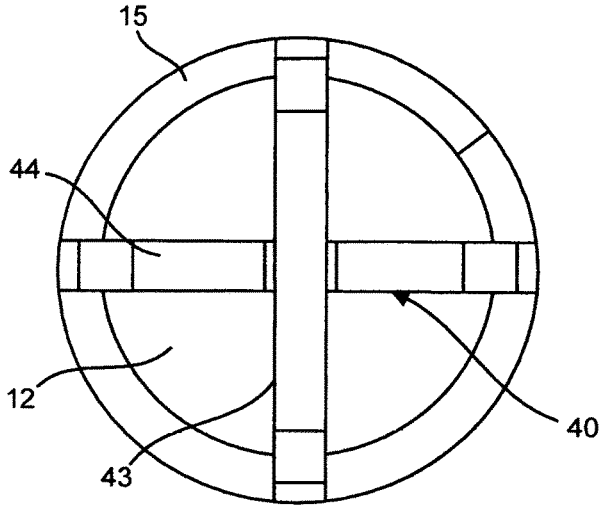
FIGS. 12A to 12C are cross-section views illustrating interconnectable hollow steel pipe of different cross-sectional shape in which plate connectors are secured.
Figure 12B:
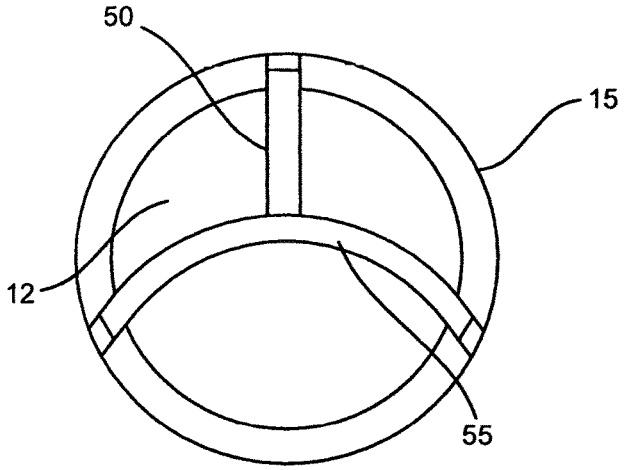
Figure 12C:
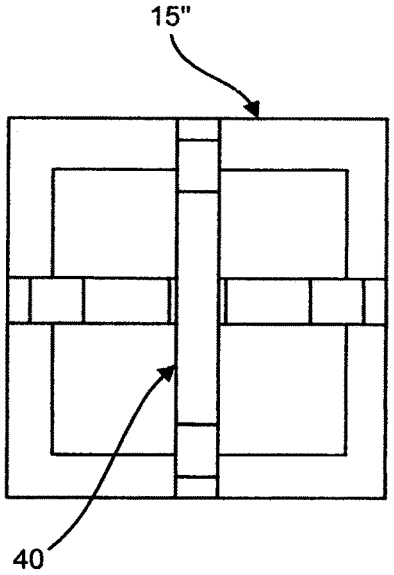

Although the hollow steel pipe 15 illustrated in the embodiments of FIGS. 1 and 5 are of circular cross-section, it is pointed out that as shown in FIG. 12A to 12C they can be of different cross-sections. Also, the pipe connector 11 and 40 may be formed by differently shaped plates, FIG. 12B illustrating a first plate 55 having a curved shape and an inner straight plate 56 connected thereto and adapted to fit in three slots formed longitudinally of the hollow pipe end or adapted the interconnect with a connector disc in a similar manner as described above. FIG. 12A is an end view showing the pipe connector 40 of FIG. 5 secured in the hollow end 12 of the pipe 15. FIG. 12C shows the pipe connector 40 of FIG. 5 connected in the hollow end of a square pipe 15". Accordingly, these figures illustrate certain modifications of the preferred embodiments described above and other such modifications are intended to be covered provided that they fall within the scope of the appended claims.

Figure 13:
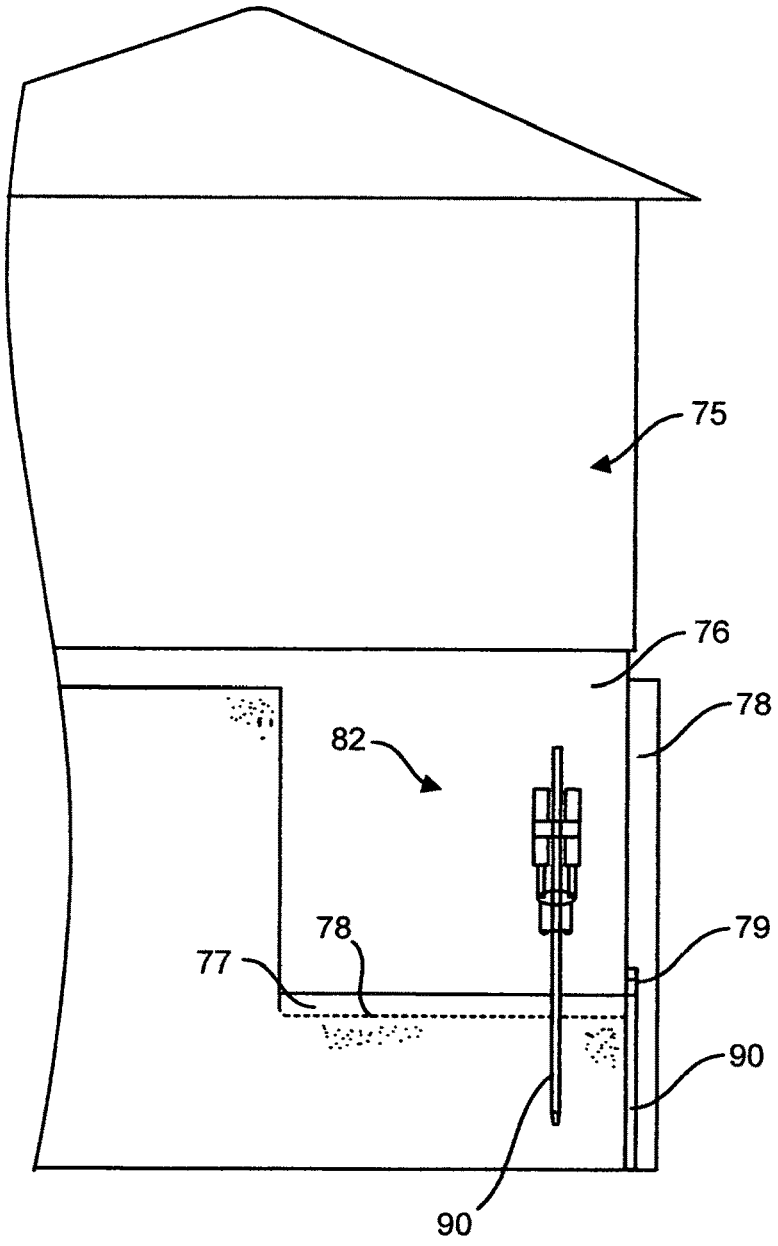
FIG. 13 is a schematic illustration of a building structure to which a foundation brackets are secured to assemble piles comprised of interconnectable hollow metal pipes constructed in accordance with the present invention and force driven into the ground by a foundation load transmitting piston assembly.
Figure 15:
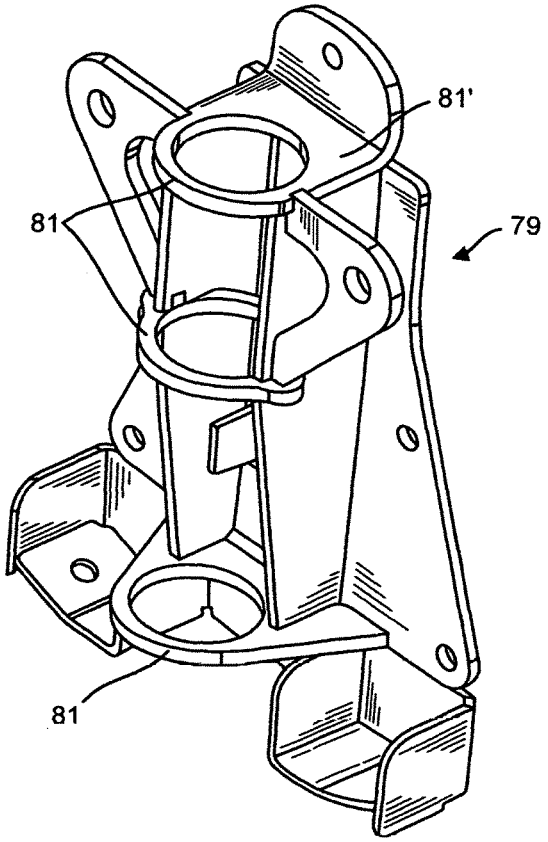
(PRIOR ART) FIG. 15
FIG. 15 is a perspective view of a prior art foundation bracket.
Figure 16:
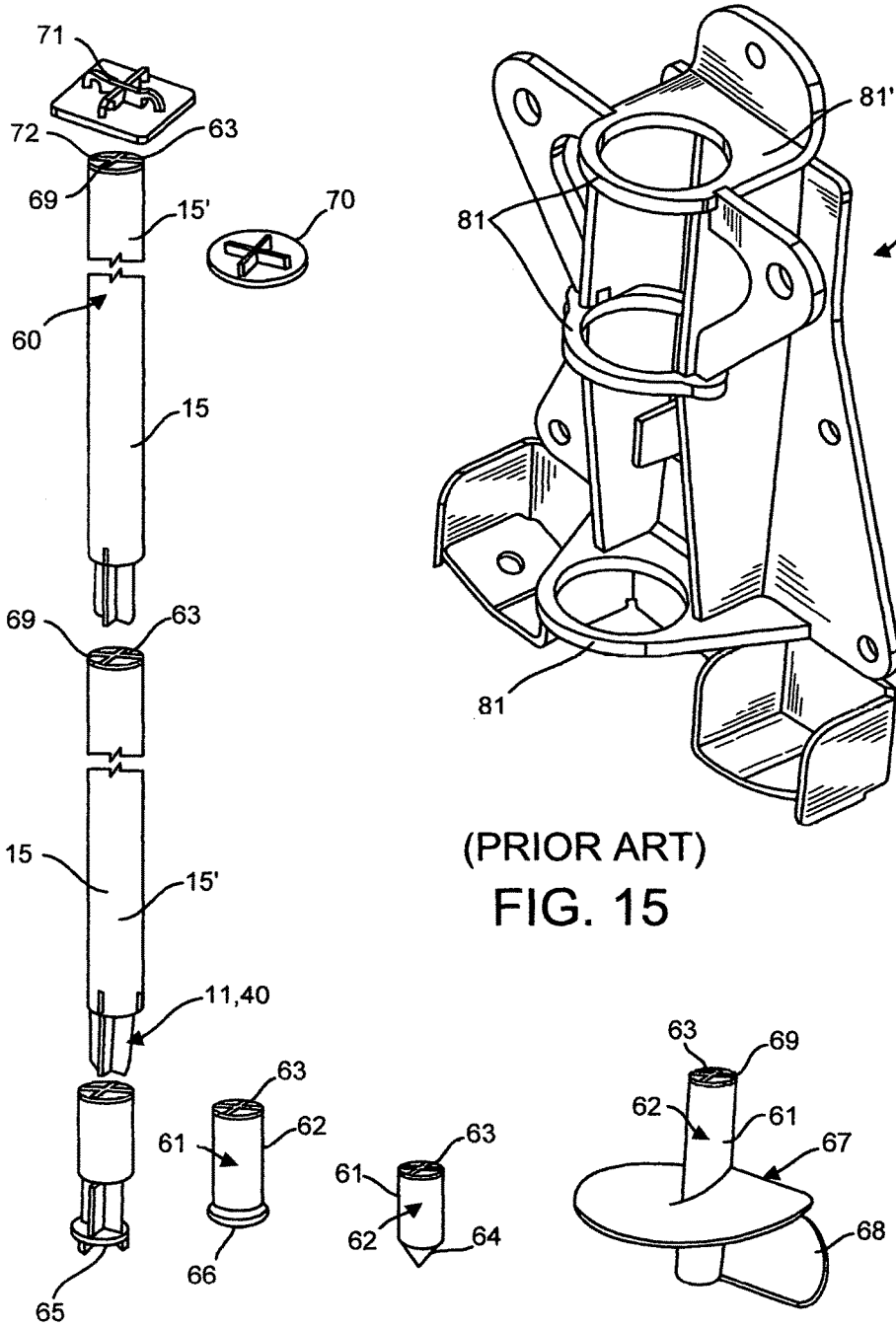
FIG. 16 an exploded view showing a pile assembly constructed with interconnectable hollow metal pipes of the present invention and various adaptors securable thereto including a torque transmitting disc securable in one of the free hollow end of the pipe to receive the connector therein of an upper pipe and impart a rotational torque to the pile as it is force driven into the ground by an impact force or a linear foundation load force.

FIG. 16 is an exploded view of a force driven pile 60 constructed in accordance with the present invention and showing various accessories thereof. As shown, various type of boring heads 61 can be connected to a free open end of a first pile to be driven into the ground or to the pipe connector 11 or 40 of an interconnectable pipe constructed in accordance with the present invention. Different types of boring heads 61 are herein illustrated but all have a coupling steel sleeve 62 having the same diameter as the pile pipes 15 with the top end thereof having a connector disc 63 formed with weld cavities in its peripheral edge, as described with reference to the disc 17 not to form an obstruction with the outer surface 15' of the pipes 15. The disc 63 has an X-shaped, or cross-shaped, through bore for receiving the assembled plates of the connector 11, 40 therein to form a connection. The leading head of the sleeves 62 may have a pointed formation 64, a flat plate 65 or a carbide bit 66 fitted thereto. The coupling sleeve 62 may also be formed as a helical screw 67 with vanes 68 to bore into the ground as the pile is applied a torque rotation. In order for the pile tube sections to apply a torque rotation, the free end 12' of the pipes 15 is fitted with the connector disc 63 which is also provided with an x-shaped slot 69 for connection to the pipe connector 11, 40 of the embodiments of the connectors described herein. Once the pile is installed in the ground, a cap 70 or a footing support plate 71 is secured to the top end of the pile With reference to FIGS. 13 to 15, it is pointed out that the interconnectable hollow steel pipe as described herein was conceived primarily for stabilizing building foundations and for its use with pile connecting brackets secured to foundation walls and as described in my earlier U.S. Pat. No. 8,506,206, incorporated herein by reference. The pile may also be installed into the ground in areas where a foundation footing is to be formed and wherein the pile is caped with a support plate 70 as shown in FIG. 16 whereby to support the footing which is formed on the ground to support the foundation wall. FIG. 13 is a simplified illustration of a building structure 70 having a foundation 76 supported on a footing 78 formed on the ground 78. As shown, a pile connecting bracket 79 is secured to the foundation wall 76 by bolts 80 or other immovable connection means. The bracket 79 has guide flanges or guide rings 81 through which the pipes 15 are inserted for guiding the pipes 15 on a straight axis as they form the pile 90 and driven into the ground 78.

Figure 14:
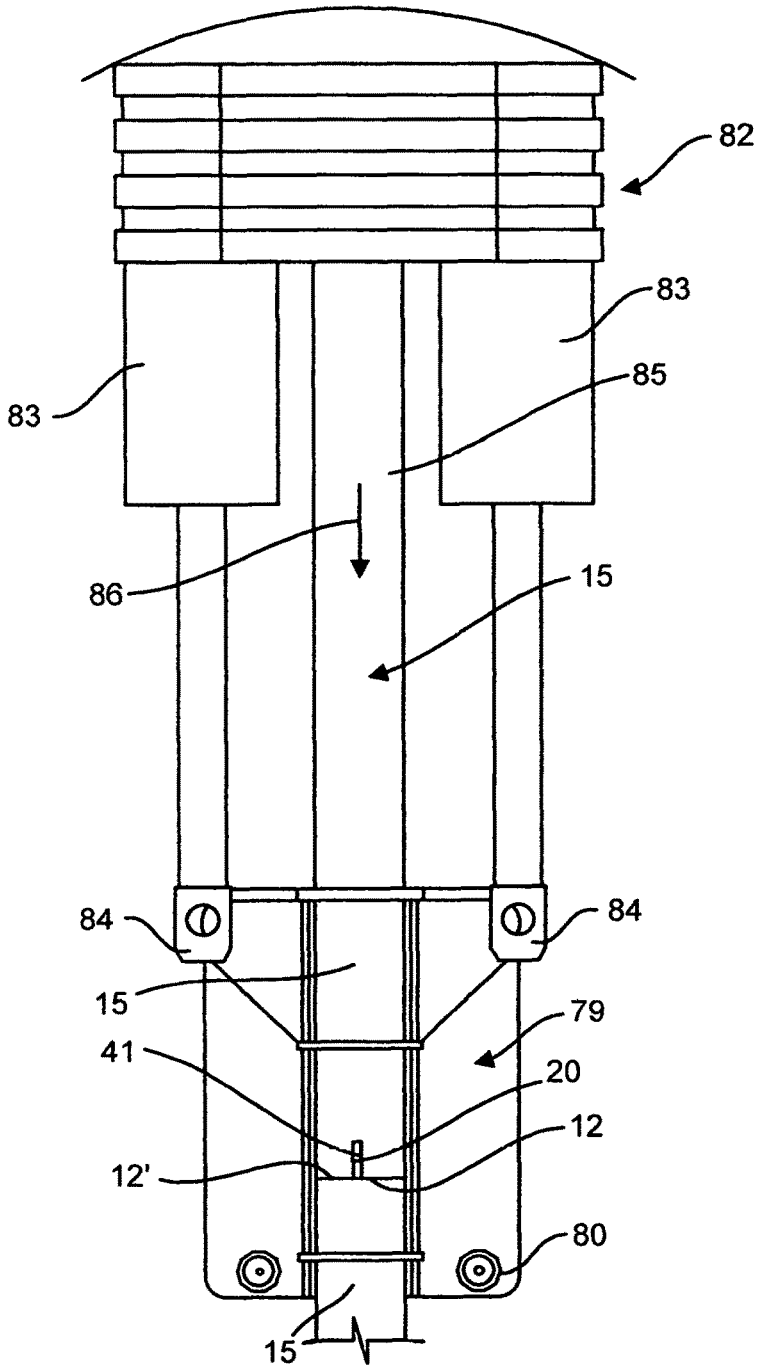
FIG. 14 is a perspective view showing how two interconnectable hollow steel pipes are interconnected and guided through guide members of the foundation bracket to be force driven into the ground along an axial path.

As shown in FIGS. 13 and 14, a hydraulic ram assembly 82, well known in the art, is provided to drive the interconnected pile tubes 15 into the ground. The hydraulic ram assembly 82 has two pistons 83 having their piston rod ends 84 secure to an upper end of the bracket 79. A friction pipe connector, not shown by described in my U.S. Pat. No. 8,506,206, clasps the outer surface of the hollow pipe tube during the piston drawing action to pull the upper hollow pipe 85 downwards in the direction of arrow 86 transferring the load of the foundation 76 into the pipe 85 pushing the pile assembly 90 into the ground. This action also permits the pipe connecting section 13 to be driven in tight friction fit into the open end 12' of the lower pipe, and this connection being made above the guide flange 81' of the bracket 79. Because the connection of the pipe connectors 11, 40 of the present invention do not have any parts exceeding the outer surface of the pipes, the pipes are displaced smoothly through the guide rings 81 without obstruction causing no damage to the bracket or the pipes. Once the pile 90 as reached a solid underground footing, the uppermost pipe is clamped onto the bracket 79 with attachments as described in my above referenced patent and any exceeding pile section is cut-off with a grinder power tool. With this pile construction and installation there is no welding required on site and no skilled labor required to form and install the piles. It is also pointed out that the pile can be forced into the ground by impacts provided by an impact power tool fitted on booms of small vehicles such as a backhoe or other suitable vehicle that can manoeuvre in tight spaces.

The method of forming a hollow steel pile to be force driven into the ground for stabilizing a foundation wall of a building structure can be summarized as follows. Firstly, an appropriate ground penetrating head 61 is attached to a protruding pipe connecting section of said pipe connector of one of a lower one of the interconnectable hollow steel pipes and positioned at a precise location with respect to an existing foundation wall or a foundation wall to be constructed. A downward drive force is applied to the top end of the steel hollow pipe to drive it into the ground. The protruding pipe connection section of a pipe connector 11, 40 of a further pipe is inserted into the free open end 12' of the lower steel pipe. A further downward drive force is applied to the further hollow steel pipe to frictionally and forceably engage the protruding pipe connection of the pipe connector in the free open end of the lower hollow steel pipe and continue to drive the hollow steel pipes into the ground until a solid underground bed is attained.

As previously described, the present invention provides a simple solution to the many problems encountered on job sites when installing pipe sections to form foundation support piles. Very often the work site is very restricted such as when forming an excavated trench adjacent an existing foundation wall when only small digging equipment has access to and there is limited room to place the excavated soil. In such environment there is limited working space and the area can become very messy, particularly in cold and rainy weather, and such can result in a poor assembly of parts and a poor installation which may be costly to a contractor if there is a need to later correct installation defects. The fewer parts necessary to form and install the pile the better is the quality of the installation and the faster is the work performed. Because the opipes are manipulated and installed by the hands people, the less is the detailed work the better is the quality of the work. With the present invention there are no loose parts and no skilled welder required during the assembly and installation of the piles resulting in quality pile installations at reduced cost and in shorter installation time.

It is within the ambit of the present invention to provide any obvious modifications of the preferred embodiments described herein provided such modifications fall within the scope of the appended claims.

The invention claimed is:

1. An interconnectable hollow metal pipe for the construction of force driven piles, said hollow metal pipe being comprised by: an elongated hollow metal pipe of predetermined length having a pipe connector, said pipe connector having a fitment section for connection in one of opposed hollow transverse ends of said hollow metal pipe for securing said pipe connector in said one of said hollow opposed transverse ends, the other of said opposed hollow transverse ends being a hollow transverse end, said pipe connector having a protruding pipe connecting section dimensioned for sliding fit in said other hollow transverse end of another of said hollow metal pipe, said pipe connector also having a flat transverse metal connector disc secured intermediate said fitment section and said protruding pipe connection section, said connector disc having an outer circumferential edge shaped for flush fit with an outer surface of said hollow metal pipe, and at least two spaced-apart weld cavities formed in said outer circumferential edge adjacent said outer surface of said elongated hollow metal pipe, said weld cavities each configured to have formed therein a weld not exceeding said outer surface of said hollow metal pipe to interconnect said weld cavities and said connector disc with a transverse end wall of said hollow metal pipe to provide an unobstructed pile outer surface comprised of two or more of said hollow metal pipes interconnected end-to-end by at least one of said pipe connectors.

2. The interconnectable hollow metal pipe as claimed in claim 1 wherein said connector disc is removably connected to said fitment section and said protruding pipe connecting section.

3. The interconnectable hollow metal pipe as claimed in claim 2 wherein said pipe connector is formed by two flat metal plates having sliding fit connection means for positioning and attachment of said two metal plates to one another in transverse alignment, said metal plates being of substantially rectangular outline and each having a notch formed in opposed longitudinal edges thereof with said notches lying in a common transverse plane when said two metal plates are attached to one another, said connector disc having an x-shaped opening formed centrally therethrough forming transverse connecting plate passages with a far end of said passages having a plate connecting formation, each said plate passages having a plate insertion section and a plate clamping section, said plate insertion section permitting unobstructed positioning of one of said pipe connector metal plates between opposed ones of said transverse connecting plate passages, said plate clamping section being recessed from a side edge of said plate insertion section and defining a curved clamping edge disposed for frictional engagement with said opposed longitudinal edges of respective ones of said two flat metal plates of said pipe connector when a rotational torque force is imparted between said interconnected metal plates and said connector disc.

4. The interconnectable hollow metal pipe as claimed in claim 3 wherein there are four of said spaced-apart weld cavities, each said weld cavity being disposed in an area of said outer circumferential edge intermediate said transverse connecting plate passages, said weld cavities being elongated cavities having a depth substantially equal to the thickness of said hollow metal pipe.

5. The interconnectable hollow metal pipe as claimed in claim 3 wherein said sliding fit connection means includes transverse central slots formed centrally in said metal plates, said protruding pipe connecting section having opposed inwardly tapering outer edges shaped for ease of insertion in said other transverse end of said another of said hollow metal pipe and for friction fit retention with an inner surface of said hollow metal pipe.

6. The interconnectable hollow metal pipe as claimed in claim 1 wherein said hollow metal pipe has one of a circular and square shaped cross-section.

7. The interconnectable hollow metal pipe as claimed in claim 1 wherein there is further provided a torque transmitting disc immovably connected to said other of said opposed hollow transverse ends adjacent said outer surface of said hollow metal pipe, said torque transmitting disc having a shaped through bore formed therein for receiving engagement with said protruding pipe connecting section of a further one of said hollow metal pipe whereupon a rotational force is transmitted thereto.

8. A method of forming a hollow metal pile to be force driven into the ground for stabilizing a foundation wall of a building structure, said method comprising the steps of:

(i) providing two or more interconnectable hollow metal pipes as claimed in claim 1;

(ii) securing a ground penetrating head to said protruding pipe connecting section of said pipe connector of one of said two or more interconnectable hollow metal pipes;

(iii) positioning said one of said two or more interconnectable hollow metal pipes at a precise location with respect to an existing foundation wall or foundation wall to be constructed;

(iv) applying a downward drive force to said one of said hollow metal pipes to drive it into the ground;

(v) positioning said protruding pipe connecting section of a further of said two or more of said hollow metal pipes into said other hollow transverse end of said one of said hollow metal pipes, and (vi) applying a further downward drive force to said further of said hollow metal pipes to frictionally and forceably engage said protruding pipe connecting section in said other hollow transverse end of said one of said hollow metal pipes and to continue to drive said one and said further of said hollow metal pipes into said ground.

9. The method of claim 8 wherein said step (iii) comprises positioning said one of said two or more interconnectable hollow metal pipes at a location on the surface of the ground in an area of a foundation wall footing to be formed, and wherein after step (vi), there is provided the further step (vii) of attaching a support connecting plate to said other hollow transverse end of a top one of said hollow metal pipes forming a driven pile, said other hollow transverse end of said top one of said hollow metal pipes forming said driven pile being formed by severing a top portion of said top one of said hollow metal pipes forming said driven pile at a location above said surface of said ground.

10. The method of claim 8 wherein there is further provided the steps of securing a pile attaching bracket to a foundation wall of a building structure, positioning said one of said two or more hollow metal pipes in close sliding fit in guide means of said bracket, and applying said drive force of step (iv) and interconnecting additional of said hollow metal pipes end-to-end until said one of said two or more hollow metal pipes is arrested by a solid underground mass.

11. The method of claim 10 wherein there is further provided the step of immovably securing an upper one of said additional hollow metal pipes to said pile attaching bracket and severing any excess upper portion of said upper one of said additional hollow metal pipes.

12. An interconnectable hollow metal pipe for the construction of force driven piles, said hollow metal pipe being comprised by: an elongated hollow metal pipe of predetermined length having a pipe connector, said pipe connector having a fitment section for connection in one of opposed hollow transverse ends of said hollow metal pipe for securing said pipe connector in said one of said opposed transverse ends, the other of said opposed hollow transverse ends being a hollow transverse end, said pipe connector having a protruding pipe connecting section dimensioned for sliding fit in said other hollow transverse end of another of said hollow metal pipe, said pipe connector having securement means forming at least two spaced-apart weld cavities with an outer surface of said hollow metal pipe, said weld cavities each configured to have formed therein a weld not exceeding said outer surface of said hollow metal pipe to provide an unobstructed pile outer surface comprised of two or more of said hollow metal pipes interconnected end-to-end by at least one of said pipe connectors said pipe connector also having a torque transmitting disc immovably connected to said other of said opposed hollow transverse ends adjacent an outer surface of said hollow metal pipe, said torque transmitting disc having a shaped through bore formed therein for receiving engagement with said protruding pipe connecting section of a further one of said hollow metal pipe whereupon a rotational force is transmitted thereto.

* * * * *